US006516891B1

(12) United States Patent
Dallas

(10) Patent No.: US 6,516,891 B1
(45) Date of Patent: Feb. 11, 2003

(54) DUAL STRING COIL TUBING INJECTOR ASSEMBLY

(76) Inventor: L. Murray Dallas, 790 River Oaks Dr., Fairview, TX (US) 75089

( * ) Notice: Subject to any disclaimer, the term of this patent is extended or adjusted under 35 U.S.C. 154(b) by 0 days.

(21) Appl. No.: 09/779,087

(22) Filed: Feb. 8, 2001

(51) Int. Cl.[7] ..... E21B 19/22
(52) U.S. Cl. ..... 166/384; 166/77.3
(58) Field of Search ..... 166/77.1–77.3, 166/312, 298, 308, 384; 226/173

(56) References Cited

U.S. PATENT DOCUMENTS

| | | | | | |
|---|---|---|---|---|---|
| 4,474,236 | A | | 10/1984 | Kellett | 166/250 |
| 4,655,291 | A | | 4/1987 | Cox | 166/385 |
| 5,309,990 | A | | 5/1994 | Lance | 166/77 |
| 5,553,668 | A | | 9/1996 | Council et al. | 166/77.3 |
| 5,566,764 | A | | 10/1996 | Elliston | 166/385 |
| 5,865,249 | A | * | 2/1999 | Gipson et al. | 166/312 |
| 6,015,015 | A | * | 1/2000 | Luft et al. | 166/384 |
| 6,059,029 | A | | 5/2000 | Goode | 166/77.3 |
| 6,148,925 | A | * | 11/2000 | Moore | 166/384 |
| 6,192,983 | B1 | * | 2/2001 | Neuroth et al. | 166/250.15 |
| 6,347,664 | B1 | * | 2/2002 | Perio, Jr. | 166/77.3 |

* cited by examiner

*Primary Examiner*—David Bagnell
*Assistant Examiner*—Zakiya Walker
(74) *Attorney, Agent, or Firm*—Nelson Mullins Riley & Scarborough, LLP

(57) ABSTRACT

A coil tubing injector assembly includes a frame structure and a pair of gripper chain drive systems mounted to the frame structure. The pair of gripper chain drive systems are disposed in a common plane and spaced apart from each other, and adapted to engage a first and a second coil tubing string to inject both of the first and second coil tubing strings into, and withdraw both the first and second strings from, a subterranean well. The first and second coil tubing strings may be injected synchronously or asynchronously depending on the structure of the injector. The coil tubing injector assembly reduces the time required to perform many downhole operations, and therefore reduces well completion, stimulation and re-completion expenses.

32 Claims, 8 Drawing Sheets

DUAL STRING COIL TUBING INJECTOR ASSEMBLY

FIELD OF THE INVENTION

The present invention relates generally to devices for performing downhole operations in subterranean wells. More specifically, the invention relates to injectors for injecting coil tubing strings into subterranean wells and extracting the coil tubing strings from the subterranean wells to perform well-servicing operations.

BACKGROUND OF THE INVENTION

Continuous reeled tubing, generally known in the energy industry as coil tubing string, has been used for many years. It is much faster to run into and out of a well casing than conventional jointed, tubing.

Typically, the coil tubing string is inserted into the wellhead through a lubricator assembly or stuffing box because there is a pressure differential between an annulus of the well and atmosphere, which may have been naturally or artificially created. The pressure differential serves to produce oil or gas, or mixture thereof from the pressurized well. A coil tubing string is run in and out of a well bore using a coil tubing string injector, which literally forces the coil tubing string into the well through the lubricator assembly or stuffing box against the well pressure until the weight of the coil tubing string exceeds the force of the pressure acting against a cross-sectional area of the coil tubing string. However, once the weight of the coil tubing string overbears the well pressure, it must be supported by the injector. The injection process is reversed as the coil tubing string is removed from the well.

The coil tubing string is relatively flexible and can therefore be wound onto and pulled off of a spool, or reel, by the injector, which often acts in concert with a windlass at a power supply that drives the spool, or reel. Conventionally, a coil tubing injector assembly utilizes a pair of opposed endless drive chains which are arranged in a common plane. These opposed endless drive chains are often referred to as gripper chains and carry a series of gripping blocks which are pressed against opposite sides of the coil tubing string and thereby grip the coil tubing string. Each chain is stretched between a drive sprocket and an idle sprocket. At least one of the two drive sprockets is driven by a motor to turn one of the endless chains, to supply injection or pulling force. The other drive sprocket may also be driven, typically by a second motor, to drive the second chain in order to provide extra power. Such coil tubing string injectors with various improvements are disclosed, for example, in U.S. Pat. No. 4,655,291, entitled INJECTOR FOR COUPLED PIPE, which issued to Cox on Apr. 7, 1987; U.S. Pat. No. 5,553,668, entitled TWIN CARRIAGE TUBING INJECTOR APPARATUS, which issued to Council et al. on Sep. 10, 1996; and U.S. Pat. No. 6,059,029, entitled COILED TUBING INJECTOR, which issued to Goode on May 9, 2000.

Another type of coil tubing string injector is disclosed in U.S. Pat. No. 5,566,764, entitled IMPROVED COIL TUBING INJECTOR UNIT which issued to Elliston on Oct. 22, 1996. Elliston describes a coil tubing string injector unit including a main injector frame having a longitudinal opening that defines a vertical run for the injector unit, which can be aligned with the well bore vertical axis. Elliston's injector unit has only one gripper chain drive system that carries plier-like halves that are pivotable between an open position and a closed, gripping position as the gripper chain enters the vertical run, so that the plier halves grip a selected length of a coil tubing string fed into the main injector frame along the central vertical axis of the injector unit to inject the coil tubing string into the well bore.

The prior art known to the Applicant fails to disclose a coil tubing injector assembly that is capable of injecting dual string coil tubing into a well bore simultaneously, even though the use of tubing strings is known in the energy industry. For example, U.S. Pat. No. 4,474,236, entitled METHOD AND APPARATUS FOR REMOTE INSTALLATION OF DUAL TUBING STRINGS IN A SUBSEA WELL, which issued to Kellett on Oct. 2, 1984, discloses a method and apparatus for completing a well having production and service strings of different sizes. The method includes steps of running the production string on a main tubing string hanger and maintaining control with a variable bore blowout preventer, and then running the service string into the main tubing string hanger while maintaining control using a dual bore blowout preventer. Use of this method and apparatus is, however, time-consuming and therefore expensive.

Therefore, there exists a need for an apparatus which is adapted to simultaneously inject dual string coil tubing into, or extract dual string coil tubing from, a well bore.

SUMMARY OF THE INVENTION

It is therefore an object of this invention to provide a coil tubing injector assembly adapted to simultaneously inject dual string coil tubing into a subterranean well, or extract the dual string coil tubing from the well.

It is another object of the invention to provide a method of running coil tubing strings into a subterranean well to permit a downhole operation to be performed using a coil tubing string injection apparatus adapted to inject dual string coil tubing, so that the dual string coil tubing may be injected synchronously or asynchronously.

In general, the present invention provides a coil tubing injector assembly that comprises a frame structure; and a gripper chain drive system mounted to the frame structure and adapted to engage first and second coil tubing strings, to inject both the first and second coil tubing strings into, and withdraw both the first and second coil tubing strings from, a subterranean well. The gripper chain drive system preferably comprises a pair of gripper chains disposed in a common plane and spaced apart from each other so that a length of the first and second coil tubing strings are temporarily engaged between, and are moved by the pair of gripper chains.

The coil tubing injector assembly in accordance with one embodiment of the invention, includes a frame structure and a pair of substantially identical gripper chain drive systems mounted to the frame structure, disposed in a common plane and spaced apart from each other to inject both a first and a second coil tubing string into, and withdraw both the first and second coil tubing strings from, a subterranean well. Each of the gripper chain drive systems includes a drive shaft and an idle shaft respectively rotatably mounted to the frame structure. The gripper chain engages a drive sprocket and an idle sprocket mounted to the respective drive and idle shafts. The gripper chain includes coil tubing string gripping blocks adapted to grip both of the coil tubing strings, and each coil tubing string gripping block has a first side for engaging the first coil tubing string and a second side for engaging the second coil tubing string. Each side has a predetermined thickness so that a secure engagement with the coil tubing strings is ensured, even if the coil tubing strings have different diameters.

A pair of pressure beams are mounted to the frame structure for supporting the respective gripper chains. The pressure beam preferably includes a roller chain system for reducing friction between the beam and the gripper chain. The respective pressure beams are movable to grip or release the first and second coil tubing strings, as required.

In accordance with another embodiment of the invention, each of the pair of gripper chain drive systems includes a first and second gripper chain drive sub-system supported by the frame structure in a parallel relationship. Each of the sub-systems includes a drive shaft, an idle shaft and a gripper chain engaged with a drive sprocket and an idle sprocket mounted to the respective drive and idle shafts. The gripper chain carries coil tubing string gripping blocks for engaging one of the coil tubing strings so that the first and second coil tubing strings are respectively engaged between, and are moved by the respective first gripper chain drive sub-systems and second gripper chain drive sub-systems.

Each of the sub-systems is equipped with a pressure beam for supporting the gripper chain when the gripper chain engages the coil tubing string. The pressure beam preferably includes a roller chain system for reducing friction between the beam and the gripper chain. The pressure beams are movable with respect to each other to support the respective gripper chains when they engage the first and second coil tubing strings.

The drive shafts of the sub-systems of each gripper chain drive system may be aligned with each other to form an integral drive shaft. If so, the sprockets mounted on the integral drive shaft have the same diameter, so that the first and second coil tubing strings are injected or withdrawn at the same speed. The idle shafts of the sub-systems of each gripper chain drive system may also be aligned axially with each other to form an integral idle shaft. The idle sprockets mounted on the integral idle shaft also have the same diameter.

In accordance with a further embodiment of the invention, the drive shafts of the pair of first gripper chain drive sub-systems are rotated synchronously in opposite directions, but independently of the drive shafts of the pair of second gripper chain drive sub-systems so that the first and second coil tubing strings may be injected independently of one another, or at different rates.

In accordance with another aspect, the invention provides a method of running coil tubing strings into a subterranean well to permit a downhole operation to be performed. The method comprises a step of injecting first and second coil tubing strings through a wellhead into the well using a coil tubing string injection apparatus adapted to inject- the first and second coil tubing strings into the well simultaneously. The first and second coil tubing strings may be injected either synchronously or asynchronously to satisfy different requirements in various applications. The coil tubing injector assembly and the method of running coil tubing strings using the coil tubing injector assembly in accordance with the invention is adapted for use in a wide variety of applications. For example, the invention enables a well stimulation process to be conducted using two coil tubing strings simultaneously. One coil tubing string is used to stimulate a production zone above a packer or a plug, while the other coil tubing string runs through the packer or plug and is used to stimulate a production zone below the packer or plug. The dual string coil tubing can also be used to stimulate separate production zones by pumping down one coil tubing string first, and then pumping down the second coil tubing string after stimulating the first zone, without repositioning the respective coil tubing strings, the packer or plug.

The invention also enables one coil tubing string to be used for stimulation, while the second coil tubing string is used to record actual downhole pressure and temperature. The invention also enables one coil tubing string to be used for well stimulation, while the other coil tubing string is used to spot fluids such as prefrac acids, etc., if required. If the first coil tubing string is used for stimulation, the second coil tubing string may be kept in reserve for cleanout, in the event of a screenout. The invention also permits the first coil tubing string to be used to stimulate the well, while the second coil tubing string is used to house electrical conductors for detonating perforating charges in a perforating/stimulation fluid injector tool.

The injector assembly in accordance with the invention can also be used to inject any flexible, seamless member into a well, such as a wireline, for example.

The features and advantages of the present invention will be better understood with reference to preferred embodiments as described below.

BRIEF DESCRIPTION OF THE DRAWINGS

Having thus generally described the invention, reference will now be made to the accompanying drawings by way of examples only, with reference to the following drawings, in which.

DETAILED DESCRIPTION OF THE PREFERRED EMBODIMENT

Figure 1:
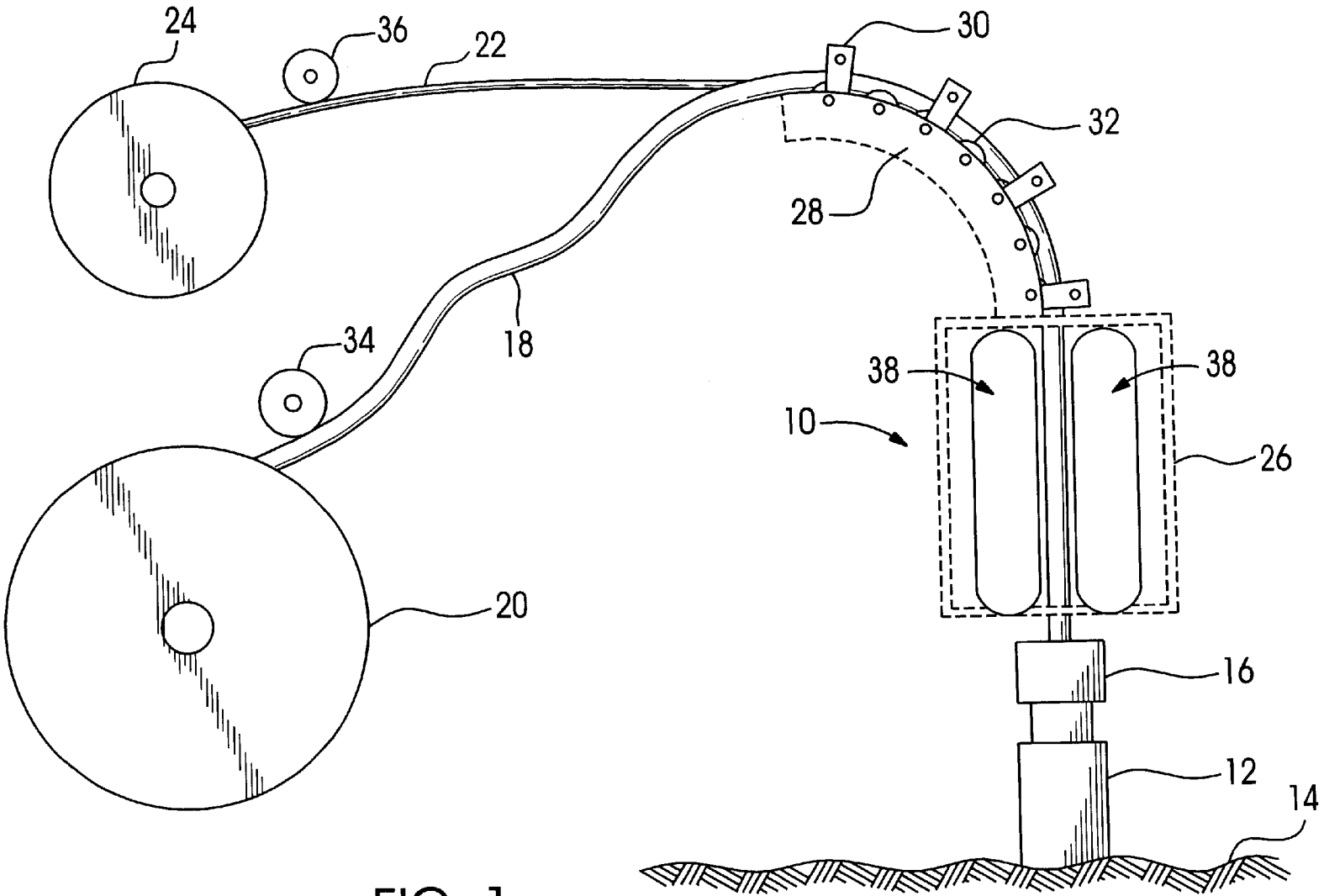
FIG. 1 is a schematic side elevational view of a coil tubing injector assembly in accordance with one embodiment of the invention, showing two coil tubing strings being simultaneously injected into a subterranean well.
Figure 2:
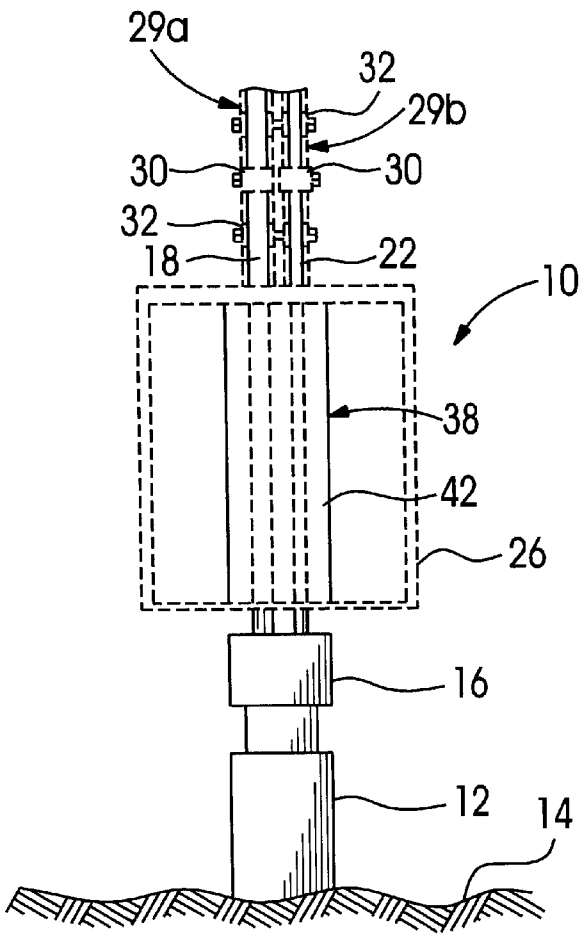
FIG. 2 is a schematic front elevational view of one embodiment of the invention in which a single gripper chain drive system is used.

FIGS. 1 and 2 schematically illustrate a coil tubing injector assembly in accordance with the present invention, generally indicated by reference numeral 10. The coil tubing injector is positioned above a wellhead 12, and may be supported by the wellhead 12, or on ground surface 14, in a manner well known in the art. A lubricator or stuffing box 16 is connected to a top end of wellhead 12 to contain well pressure while coil tubing and/or downhole tools is/are run into or out of the well, as will be explained below in more detail.

A first coil tubing string 18 is supplied from a reel 20. Similarly, a second coil tubing string 22, which may have a different diameter than coil tubing string 18, is supplied from another reel 24, Each of the coil tubing strings is typically several thousand feet in length. The coil tubing strings 18 and 22 are in a relaxed but coiled state as they are supplied from the respective reels 20 and 24. Coil tubing strings 18 and 22 are spooled from the respective reels, which are normally supported on trucks (not shown) to provide mobility.

The coil tubing injector assembly 10 includes a frame structure 26, which may be constructed in any number of ways well known in the art. Extending upwardly from the frame structure 26 is a coil tubing guide framework 28 that supports a plurality of rotatably mounted guide rollers 30 and 32 that guide the respective coil tubings 18, 22 into the tubing injector. The coil tubing strings 18 and 22 are run between respective sets of rollers 30 and 32, as better seen in FIG. 2. As coil tubing strings 18 and 22 are unspooled from reels 20 and 24, their length is generally measured by respective measuring devices, such as measuring wheels 34 and 36, or the like. Alternatively, one or more measuring device(s) may be incorporated into the coil tubing injector assembly 10, in a manner well known in the art.

Rollers 30 and 32 supported by the framework 28 define two pathways for respective coil tubing strings 18 and 22, so that any curvature in the coil tubing strings coming off the reels 20, 24 is slowly straightened as coil tubing strings 18 and 22 enter coil tubing injector assembly 10. The respective sets of rollers 30 and 32 are spaced apart so that straightening of the coil tubing is accomplished as the coil tubing strings 18 and 22 are inserted into the well by a pair of substantially identical gripper chain drive systems 38 spaced apart from one another and disposed in a common plane. The coil tubing strings 18 and 22 pass through the coil tubing injector assembly 10 and are securely supported in the grip of the pair of spaced gripper chain drive systems 38, which include gripper blocks that are forced against each of the coil tubing strings 18 and 22 to frictionally engage the respective coil tubing strings. The gripper chain drive systems 38 are driven by means of pressurized hydraulic fluid, for example, in a direction to move the coil tubing strings 18 and 22 into the well, or to move the coil tubing strings 18 and 22 out of the well, as required. Pressurized hydraulic fluid may also be used to power a pressure mechanism for gripping or releasing the coil tubing strings 18 and 22, as will be explained below in more detail.

FIG. 2 is a front elevational view of a first embodiment of the coil tubing injector 10 in accordance with the invention. As shown in FIG. 2, the coil tubing guide framework 28 includes adjacent coil tubing guides 29*a*, 29*b*, which are preferably interconnected by the coil tubing guide framework 28, though interconnection of coil tubing guides 29*a*, 29*b* is not required. The coil tubing guide 29*a* straightens coil tubing 18 as it is fed into the gripper chain drive systems 38, as explained above. The coil tubing guide 29*b* straightens coil tubing 22 in the same way.

Figure 4:
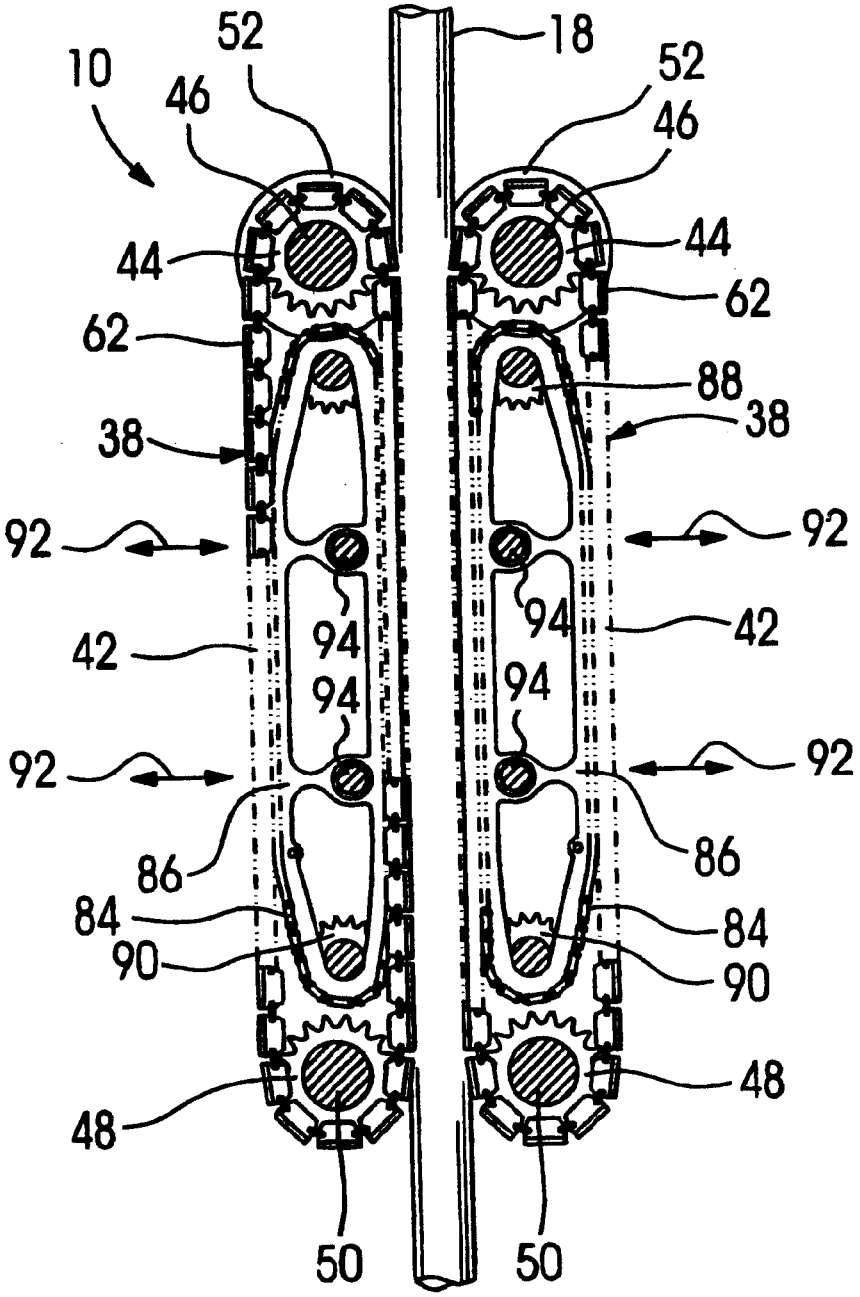
FIG. 4 is a side elevational view of gripper chain sub-assemblies of the embodiment shown in FIG. 1.

FIG. 4 illustrates the gripper chain drive systems 38 in greater detail. The gripper chain drive systems 38 shown in FIG. 4 is illustrated in side elevational view so that a length of coil tubing string 18 engaged therein may be seen. The coil tubing string 22 is behind the coil tubing string 18 and therefore not shown. The gripper chain drive systems 38 are driven by hydraulic motors 52 preferably connected to respective transmissions. Each of the gripper drive chain systems 38 respectively include a gripper chain 42 which is driven by the drive sprocket 44 mounted to a drive shaft 46. The drive sprocket 44 and drive shaft 46 are connected to hydraulic motors 52 through transmissions (not shown). An idle sprocket 48 is mounted to an idle shaft 50 and engages the lower loop of the gripper chain 42. The pair of drive shafts 46 are rotatably mounted to the frame structure 26 (FIG. 1). The pair of idle shafts 50 are pivotally mounted to the frame structure 26 by means of a tensioner to provide adjustment of the tension of the gripper chains 42, using any one of several tensioning systems well known in the art.

Figure 5:
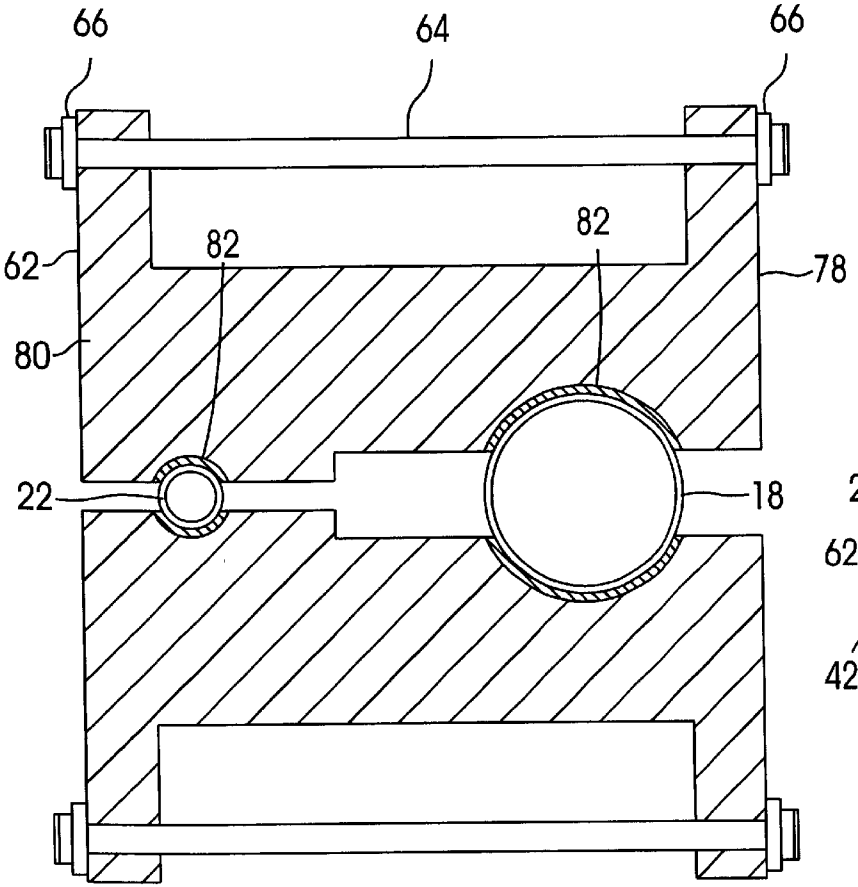
FIG. 5 is a cross-sectional view of a first embodiment of gripping blocks used in the coil tubing injector assembly for synchronously injecting two coil tubing strings into the subterranean well.

Each of the gripper chains 42 includes a plurality of links 66 that interconnect coil tubing gripping blocks 62, each having a width and configuration adapted to engage one or both of the coil tubing strings 18 and 22, as shown in FIGS. 4 and 5. Each of the coil tubing gripping blocks 62 includes a pair of pins 64 that connect the links 66 to the coil tubing string gripping block 62 and engage teeth of the sprockets 46, 48. The adjacent coil tubing string gripping blocks 62 are interconnected by link members 66 to form an endless chain loop as shown in FIG. 4, which is well known in the art. In order to simultaneously engage the coil tubing strings 18 and 22 even if they have different diameters, as shown in FIG. 5, each coil tubing string gripping block 62 has a first side 78 and a second side 80 that are respectively configured to accommodate different diameters of the coil tubing string. Each gripping surface of the coil tubing string gripping blocks 62 includes a contoured surface shaped to accommodate the respective coil tubing strings 18 and 22. The gripping surfaces are coated with a non-slip material 82 to increase gripping friction.

Inside each of the gripper chains 42 is a roller chain 84. The roller chain 84 is built up from rollers connected together by links and pins, in a well-known manner. The roller chain 84 rolls freely about a periphery of a pressure beam 86 and is supported by a pair of sprockets 88 and 90 which are rotatably connected to the pressure beam 86.

The pressure beams 86 are movable toward and away from each other. When the pressure beams 86 are moved toward each other, each pressure beam 86 exerts a force against its roller chain 84 and the roller chain 84 bears against the gripper chain 42 to force it against the coil tubing strings 18 and 22. Thus, when the pressure beams 86 are forced inwardly toward each other, the coil tubing strings 18 and 22 are gripped between the gripper chains 42. The gripping force is dependent upon the force with which the pressure beams 86 are pressed against the roller chain 84 by the actuators 92, which may be hydraulic cylinders, for example. The pressure beams 86 are provided with trunnions 94, the ends of which are slidable within slots in the frame structures (not shown) so that the pressure beams 86 are supported by the frame structures and movable with respect to the frame structure. The trunnions 94 are connected to the respective actuators 92 which are also supported by the frame structure (not shown) so that the pressure beams 86 are controlled to exert the gripping force.

Figure 3:
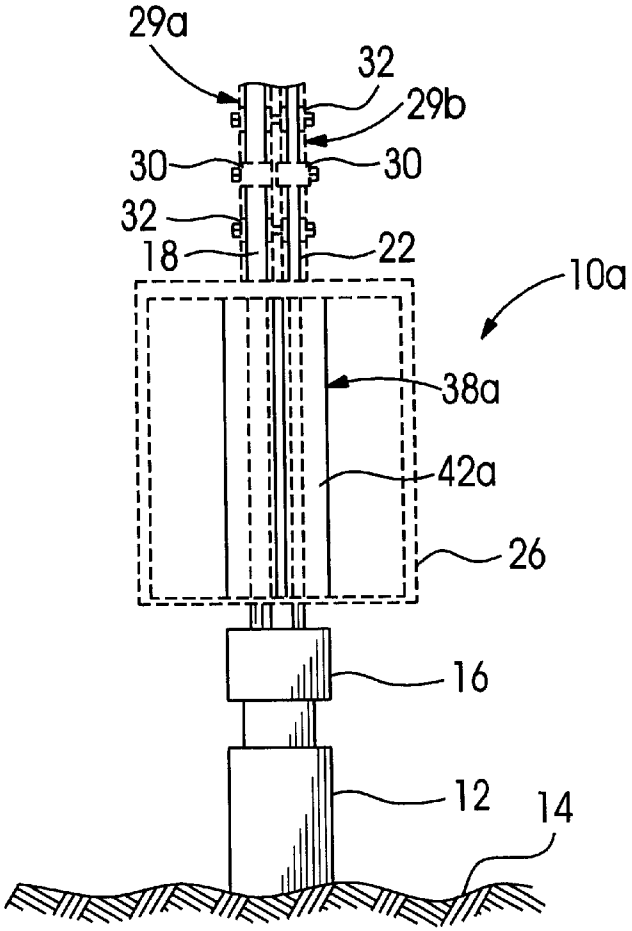
FIG. 3 is a schematic front elevational view of another embodiment of the invention, in which two gripper chain drive systems are used.
Figure 6:
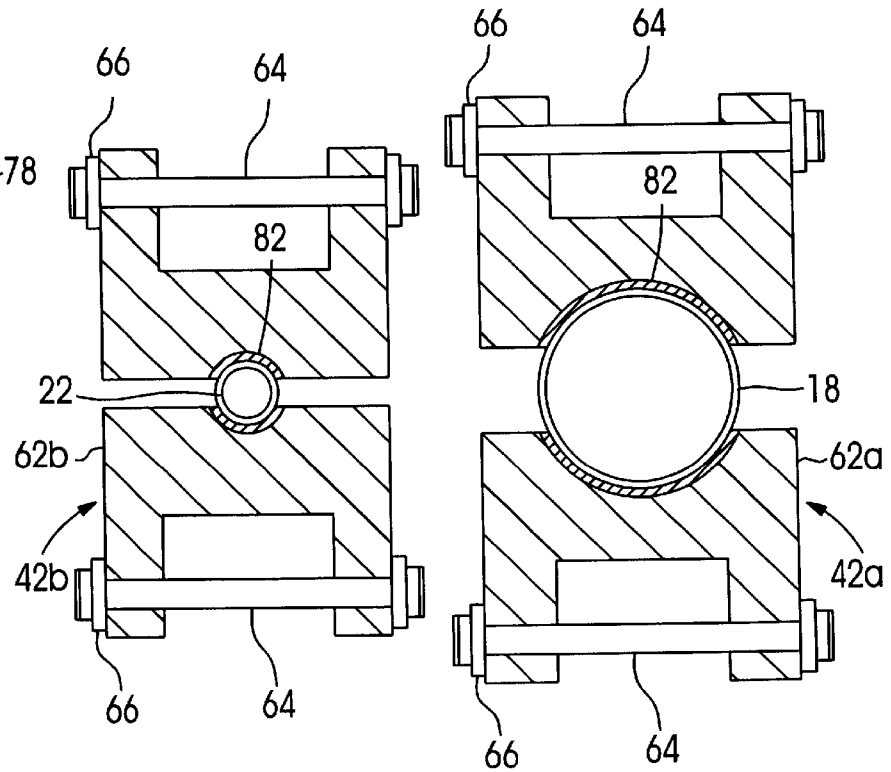
FIG. 6 is a cross-sectional view of tubing gripping blocks used in the coil tubing injector assembly, which may be configured to inject coil tubing strings synchronously or asynchronously.

In accordance with another embodiment of the present invention, schematically illustrated in FIG. 3, a coil tubing injector assembly 10*a* includes a pair of substantially identical gripper chain drive sub-systems 38*a* mounted to the frame structure 26 disposed in a common plane, and spaced apart from each other. Each of the gripper chain drive sub-systems 38*a* of the coil tubing injector assembly 10*a* includes a first and a second gripper chain 42*a* and 42*b* supported by the frame structure 26 in a parallel relationship. The gripper chains 42*a* and 42*b* have a structure similar to that of the gripper chains 42 shown in FIG. 4, and the common structures are not redundantly described. The gripping blocks 62*a* and 62*b* of the gripper chains 42*a* and 42*b* are schematically illustrated in FIG. 5. Each has a width and configuration for gripping one of the coil tubing strings 18 and 22. The coil tubing string gripping blocks 62*a* and 62*b* may be equal in width, as shown in FIG. 6, or the coil tubing string gripping block 62*b* which grips the coil tubing string 22 may be narrower to provide more space between the two parallel gripping chains 42*a* and 42*b*. The coil tubing string gripping chains 42*a* and 42*b* may respectively engage and be driven by the drive sprockets that are mounted on a common drive shaft, so that the drive sprockets are rotated synchronously to ensure the coil tubing strings 18 and 22 are injected or extracted at the same rate. Alternatively, the gripper chains may be mounted to independent drive shafts to permit the coil tubing string to be injected or extracted asynchronously, as will be explained below in more detail. Similarly, the two idle sprockets engaging the respective gripper chains 42*a* and 42*b* may be mounted on a common idle shaft.

In order to ensure that coil tubing strings 18 and 22 are securely gripped between the respective pair of gripper chains 42*a* and 42*b*, the pressure on the gripper chains 42*a* and 42*b* should be controlled using independent pressure beams 86, if the diameters of the coil tubing strings 18 and 22 are different. In order to ensure that the coil tubing strings are injected and extracted synchronously, it is preferable that the drive sprockets 44*a*, 44*b* be driven by a common drive shaft 46, as shown in FIG. 6. The drive sprockets 44*a*, 44*b* are connected to the drive shaft 46 by a key 45, for example, in a manner well known in the art.

In some downhole operations, it is desirable to inject or extract dual string coil tubing at different rates. To permit this, the injection/extraction of each coil tubing string must be independently controllable. In order to enable independent control, the respective pairs of gripper chains 42*a* and 42*b* for engaging the respective coil tubing strings 18 and 22 must be driven independently. Therefore, drive sprockets 44*a* and 44*b* (see FIGS. 8–10) that drive the respective gripper chains 42*a* and 42*b* are mounted on separate drive shafts 46*a* and 46*b*. The drive sprockets 44*a* are mounted to the drive shafts 46*a* by means of keys 45, so that the drive sprockets 44*a* are rotated together with the drive shafts 46*a*. Similarly, the drive sprockets 44*b* are mounted by means of keys 45 to drive shafts 46*b*, so that the drive sprockets 44*b* are rotated together with the drive shafts 46*b*.

Figure 8:
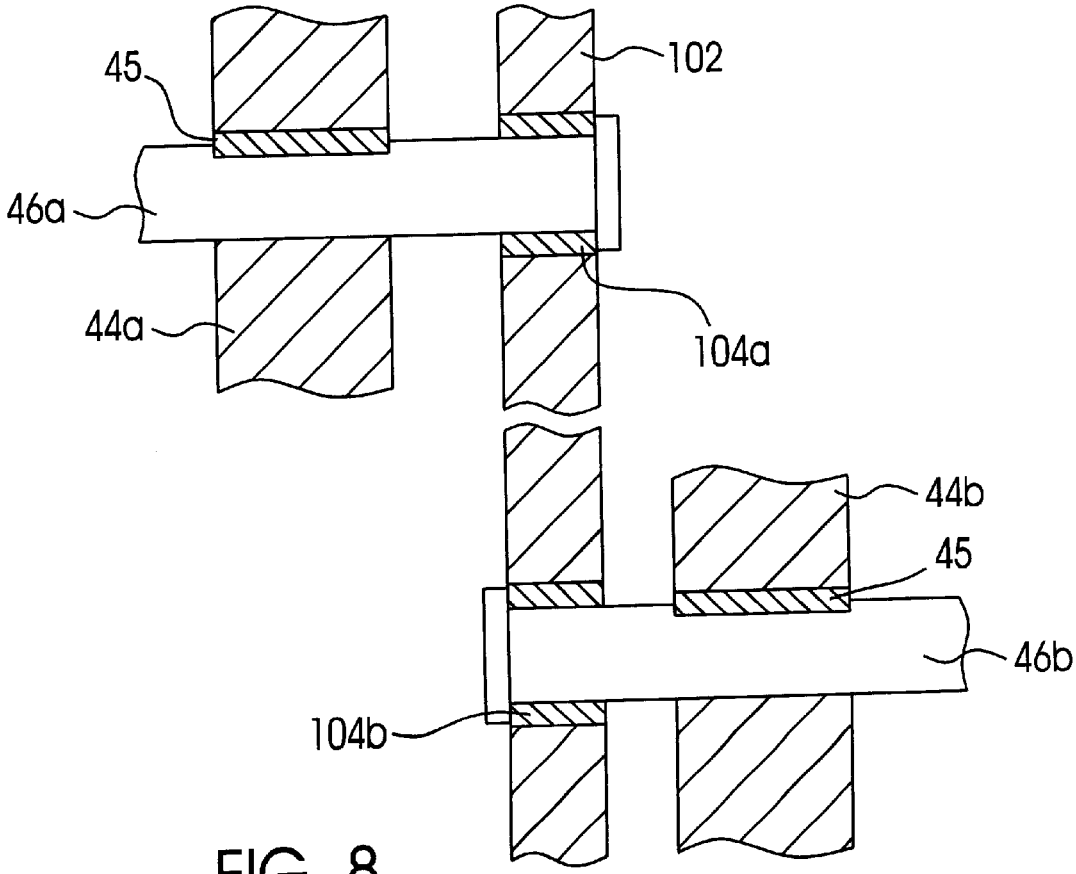
FIG. 8 is a partial cross-sectional view of two separate drive shafts with respective drive sprockets, in accordance with an embodiment of the invention, showing a vertically offset arrangement with a middle bearing support.

FIG. 8 illustrates a first arrangement for independent drive shafts for a dual string coil tubing injector 10 in accordance with the invention. In the embodiment shown in FIG. 8, the drive shafts 46*a*, 46*b* are vertically offset, and inner ends of the shafts are supported by a vertical support structure 102 and respective roller bearings 104*a*, 104*b*. The outer ends of the drive shafts (not shown) are rotatably supported by the frame structure 26 (FIG. 1).

Figure 9:
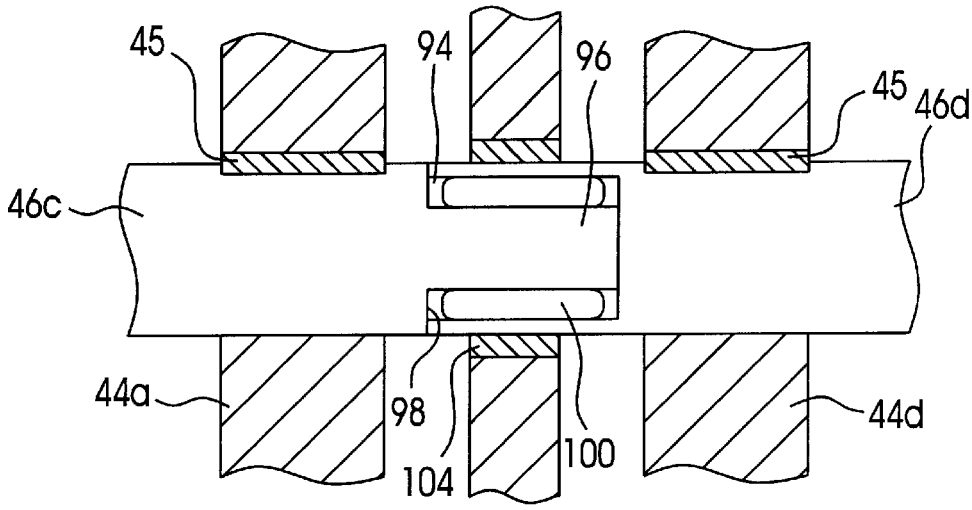
FIG. 9 is a partial cross-sectional view of the two drive shafts with drive sprockets in accordance with another embodiment of the invention, in which the two drive shafts are vertically aligned and supported by a middle bearing support.

In the embodiment shown in FIG. 9, drive shafts 46*c* and 46*d* are axially aligned and rotatably mounted at their respective outer ends to the frame structure (not shown). The drive shaft 46*d* has an axial bore 94 in its inner end that receives a turned-down end 96 of the drive shaft 46*c*. A shoulder 98 on the drive shaft 46*c* is provided to restrain the relative axial movement between the two drive shafts. A roller bearing 100 is provided in the annulus within the axial bore 94 of the drive shaft 46*d* and surrounding the end 96 of the drive shaft 46*c* so that drive shaft 46*c* and drive shaft 46*d* are rotatable independently of each other. A bearing 104 supports the interconnected drive shafts 46*c* and 46*d* to bear the load when the coil tubing strings 18 and 22 are suspended by the coil tubing injector assembly.

Figure 7:
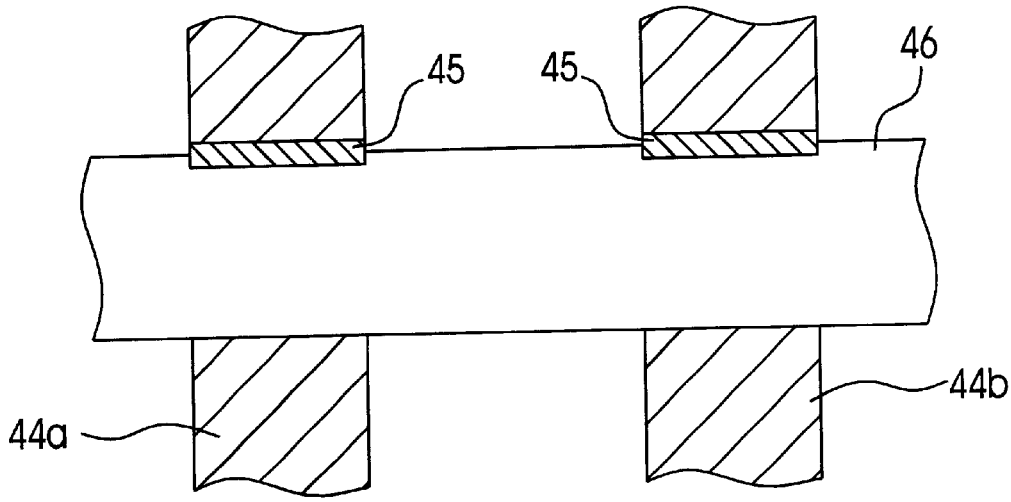
FIG. 7 is a partial cross-sectional view of a common drive shaft with two drive sprockets mounted thereon in accordance with one embodiment of the invention.
Figure 10:
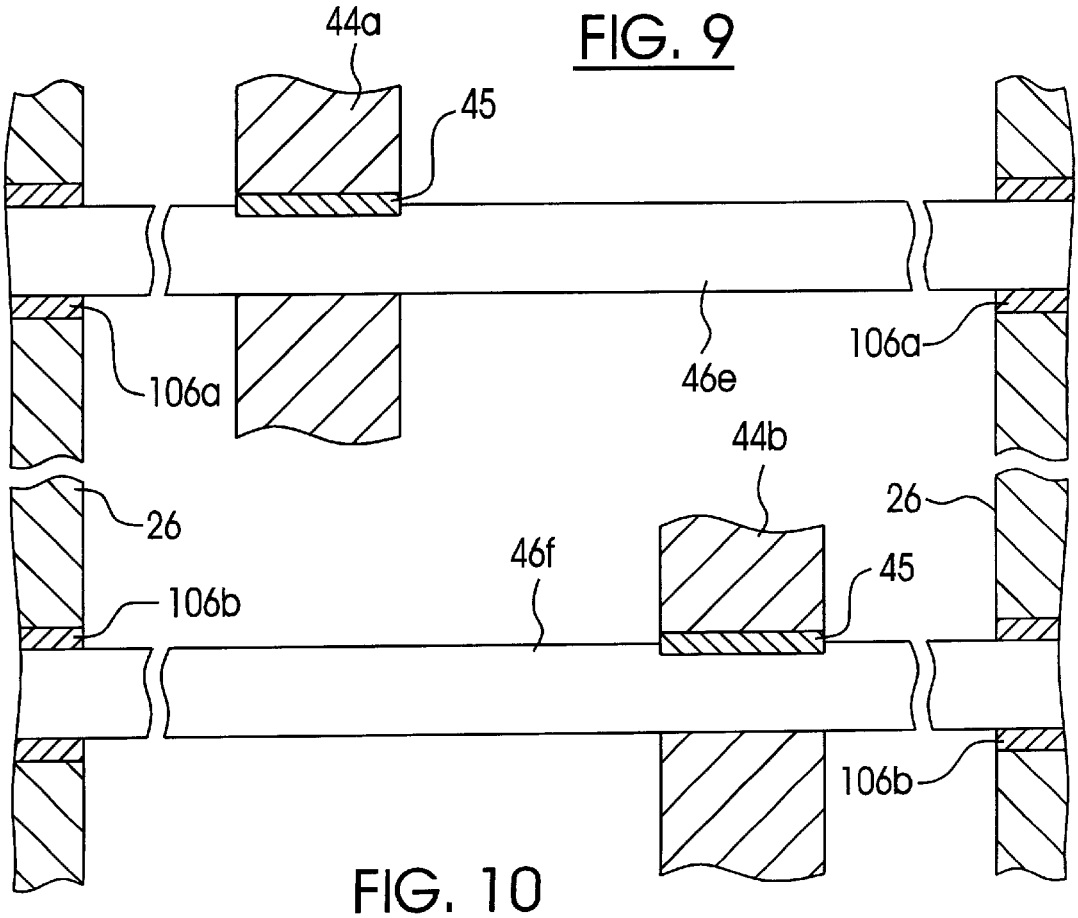
FIG. 10 is a partial cross-sectional view of two drive shafts with drive sprockets in accordance with another embodiment of the invention, in which the drive shafts are mounted in a parallel relationship without a middle bearing support.

FIG. 10 illustrates yet another arrangement for supporting two separate drive shafts 46*e* and 46*f* for a dual string coil tubing injector in accordance with yet a further embodiment of the invention. The drive shaft 46*e* for driving the drive sprocket 44*a*, and the drive shaft 46*f* for driving the drive sprocket 44*b* are longer than drive shafts 46*c* and 46*d* shown in FIG. 8, and extend across the width of the coil tubing injector assembly 10 in a vertically spaced, parallel relationship. The drive shaft 46*e* is supported at each end by a bearing 106*a* mounted to the frame structure 26, and the drive shaft 46*f* is supported at each end by a bearing 106*b* mounted to the frame structure 26. This arrangement advantageously eliminates the middle support structure 102 shown in FIG. 7.

Arrangements for two separate idle shafts can be similar to the arrangements in FIGS. 8–10, and are not described.

In operation, the pair of drive shafts 46 for driving the respective gripper chain drive systems 38 for a dual string coil tubing injector 10 that injects coil tubings synchronously, the drive shafts are rotated by two separate power sources, such as hydraulic motors 52 (FIG. 4) which rotate at the same speed, but in opposite rotational directions, or by a single hydraulic motor connected to the drive shafts through a gearbox (not shown), so that the pair of drive shafts 46 are rotated at an equal speed in opposite rotational directions. After both coil tubing strings 18 and 22 are inserted between the pair of gripper chain drive systems 38, the actuators 92 are operated to force the pressure beams 86 of each of the gripper chain drive systems 38 toward each other to firmly engage the coil tubing strings 18 and 22, which are operated to inject the coil tubing strings 18 and 22 downwardly into the well. Reverse steps are followed when the coil tubing strings 18 and 22 are extracted from the well.

In the operation of a coil tubing injector assembly 10 having two separate drive shafts for each of the gripper chain drive systems 38*a* as shown in FIGS. 8–10, the drive shafts of each of the gripper chain drive systems 38 are driven by independent hydraulic motors, which rotate independently of one another. This permits the respective coil tubing strings to be injected or extracted synchronously or asynchronously, as required. As will be explained below, there are several applications for synchronous as well as asynchronous dual string coil tubing injection.

Figure 11:
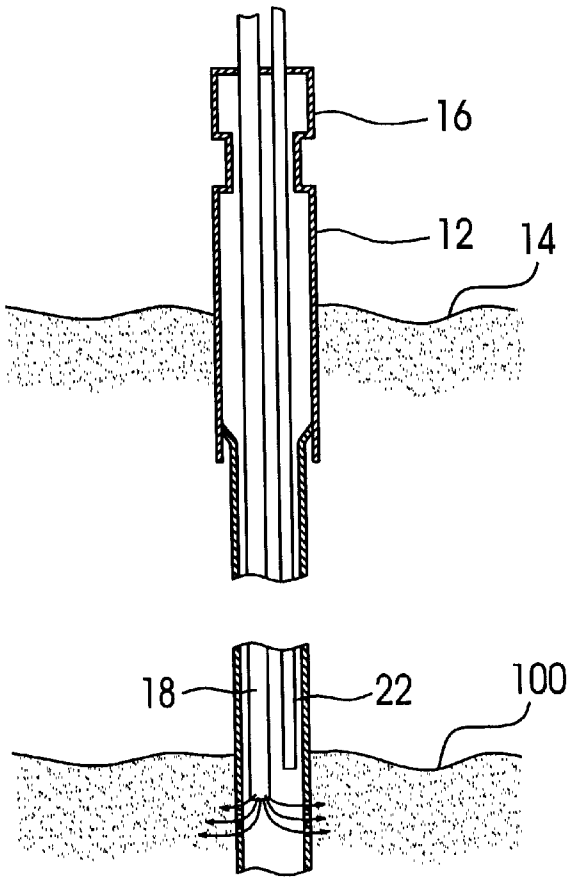
FIG. 11 is a schematic diagram illustrating a method of using the dual string coil tubing injector in accordance with the invention to perform a well stimulation procedure in which one tubing string is used to inject stimulation fluid, and the other tubing string is used to monitor downhole pressures and/or temperatures.

The coil tubing injector assembly 10 in accordance with the present invention can be advantageously used in various downhole operations. For example, FIG. 11 shows an application in which two coil tubing strings 18, 22 are injected into a downhole well bore in the vicinity of a production zone 100 requiring stimulation. Stimulation fluids are pumped in a manner well known in the art through the coil tubing string 18 to stimulate the production zone 100 while coil tubing string 22 is used to monitor downhole pressures and, optionally, downhole temperatures in order to acquire accurate downhole measurements of the stimulation process. The coil tubing strings 18, 22 may be injected synchronously or asynchronously.

Figure 12:
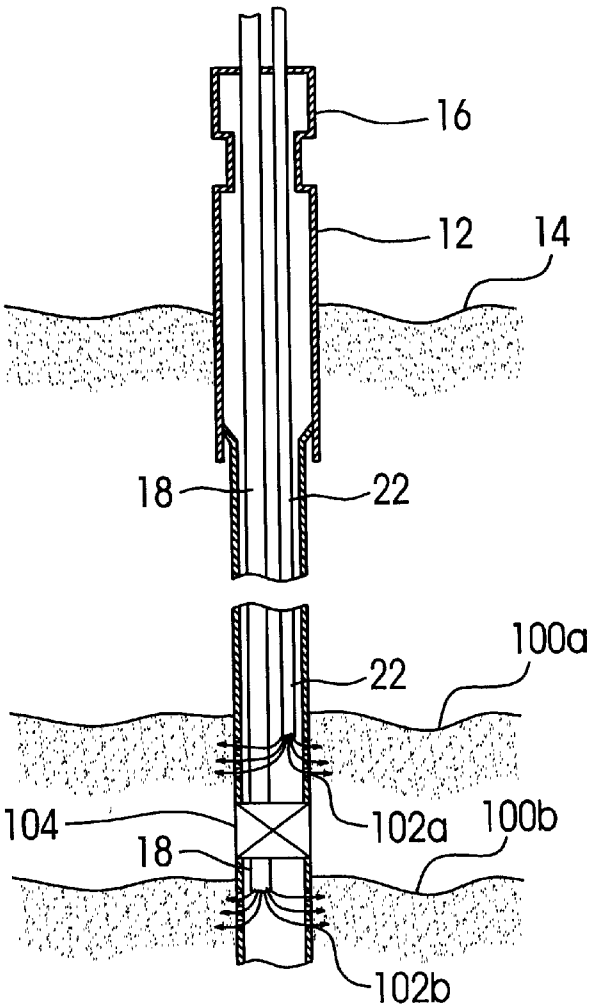
FIG. 12 is a schematic diagram illustrating a method of using the dual string coil tubing injector in accordance with the invention to perform a well stimulation procedure in which one tubing string is used to inject stimulation fluid in a first production zone and a second tubing string is used to inject stimulation fluid in a second production zone isolated by a downhole packer or plug.

FIG. 12 illustrates another application in which a first coil tubing string 18, of two coil tubing strings 18, 22, is inserted through a plug or packer 104 and inserted through the well to a position between two production zones 100*a*, 100*b*. A plug or packer is set to provide pressure isolation between the two production zones 100*a*, 100*b* and the second coil tubing string 22 is injected into the well to a depth coincident with the production zone 100*a*. Thereafter, stimulation fluid can be pumped down the two coil tubing strings 18, 22 simultaneously to stimulate the two production zones at the same time by forcing high pressure fluid through perforations 102*a*, 102*b* in a casing of the subterranean well. The two coil tubing strings 18, 22 can be injected asynchronously, or synchronously if the first coil tubing string 18 is run into the well a required distance before the second coil tubing string 22 is inserted into the dual string coil tubing injector assembly 10, as will be understood by persons skilled in the art.

Figure 13:
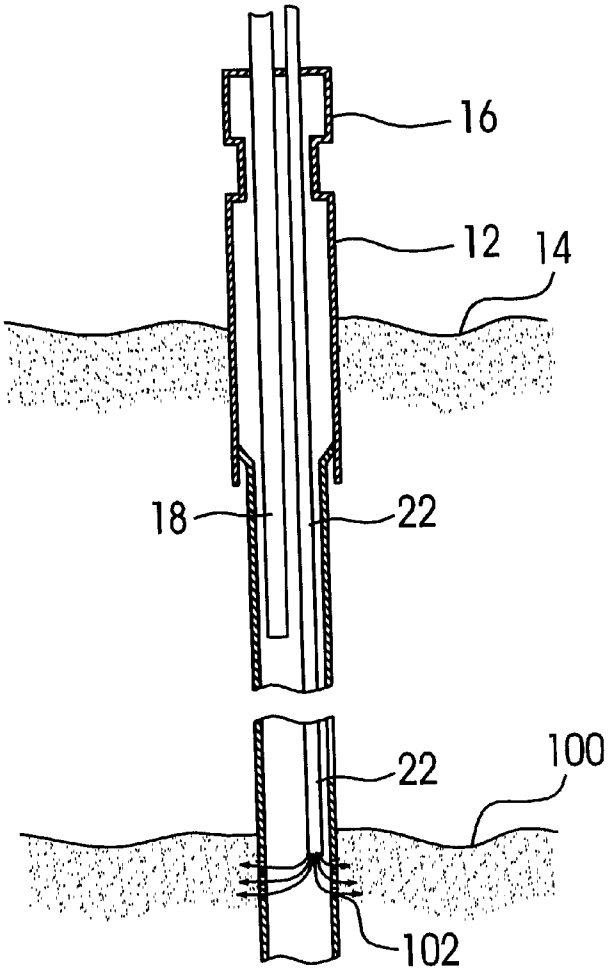
FIG. 13 is a schematic diagram illustrating a method of using the dual string coil tubing injector in accordance with the invention to perform a well stimulation procedure in which one tubing string is used to inject stimulation fluid and the other tubing string is reserved for cleanout of the well bore in the event of screenout.

FIG. 13 shows yet a further application of the dual string coil tubing injector in accordance with the invention in which a coil tubing string 22 is injected into the subterranean well to spot fluids, such as pre-fracturing acids, through perforations 102 in a casing of the subterranean well. After the fluids have been pumped into the production zone, and optionally recovered, the coil tubing string 22 may be retrieved or left in the hole and the coil tubing string 18 may be injected into the area of the production zone 100 to be used as a conduit for injecting high pressure fracturing fluids through the casing perforations 102 in a manner well known in the art. If the coil tubing string 22 is left in the well bore, it may be used as a dead string to measure downhole pressures or temperatures in a manner well known in the art.

Figure 14:
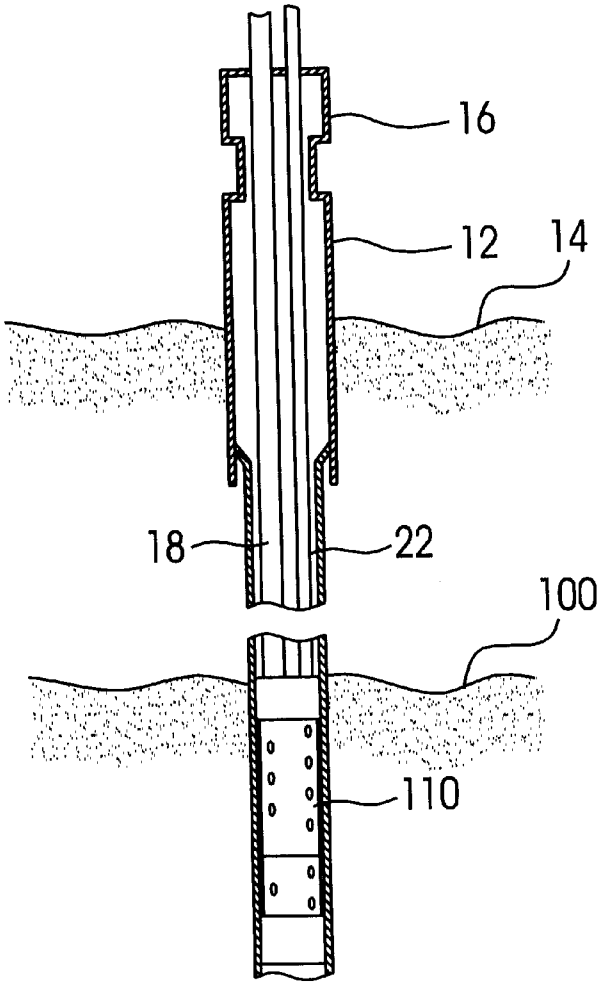
FIG. 14 is a schematic diagram illustrating a method of using the dual string coil tubing injector in accordance with the invention in which the respective coil tubing strings are connected to a multi-function tool for performing multi-function downhole operations.

FIG. 14 illustrates yet another application of the apparatus in accordance with the invention. Two coil tubing string 18, 22 are fed through the dual string coil tubing injector assembly 10 and connected to a multi-function well tool 110 as described in Applicant's copending patent application No. 09/707,739 filed on Nov. 7, 2000, the specification of which is incorporated herein by reference. The tool is then inserted into the well bore using a dual string coil tubing injector assembly 10 in accordance with the invention. After the multi-function tool is positioned in a production zone to be stimulated, the casing is perforated as described in Applicant's copending patent application and stimulation fluid is pumped through coil tubing string 18 to fracture the production zone in a single-set process. The coil tubing string 22 houses electrical conductors for selectively firing perforation guns carried by the multi-function tool 110, as also explained in Applicant's copending patent application.

The apparatus in accordance with the invention is adapted for many other downhole applications. The applications described above are therefore intended to be exemplary only.

The embodiments of the invention and the uses of the invention described are illustrative but not comprehensive of the configurations and uses to which the invention is adapted. The scope of the invention is therefore intended to be limited solely by the scope of the appended claims.

I claim:

1. A coil tubing injector assembly comprising:

a frame structure; and a gripper chain drive system mounted to the frame structure and adapted to engage a first and a second coil tubing string, to inject both the first and the second coil tubing strings in parallel into, and withdraw both the first and the second coil tubing strings in parallel from, a subterranean well.

2. An assembly as claimed in claim 1 wherein the gripper chain drive system comprises a pair of gripper chain drive sub-systems disposed in a common plane and spaced apart from one another other.

3. An assembly as claimed in claim 1 wherein the gripper chain drive system comprises a common drive shaft rotatably mounted to the frame structure, and a common idle shaft rotatably mounted to the frame structure, so that the both first and second coil tubing strings are injected or withdrawn synchronously.

4. An assembly as claimed in claim 3 wherein the gripper chain drive system comprises:

a drive sprocket mounted to the common drive shaft;

an idle sprocket mounted to the common idle shaft; and a gripper chain having coil tubing string gripping blocks attached thereto and engaged with the respective drive and idle sprockets, the coil tubing string gripping blocks being configured with a first side adapted to grip the first coil tubing string, and a second side adapted to grip the second coil tubing string to thereby move both the first and the second coil tubing strings through the frame structure as the drive sprocket is rotated.

5. An assembly as claimed in claim 4 wherein if the coil tubing strings have different diameters, the first and second sides are shaped to grip the respective diameters of the first and the second coil tubing strings, to ensure that each of the coil tubing strings is securely gripped by the respective gripping blocks.

6. An assembly as claimed in claim 4 further comprising at least one pressure beam supported by the frame structure and movable with respect to the frame structure, the at least one pressure beam being adapted to support the gripper chains while the gripper chains grip the respective coil tubing strings.

7. An assembly as claimed in claim 6 further comprising a roller chain system operatively mounted to the pressure beam for reducing friction between the at least one pressure beam and the gripper chains.

8. An assembly as claimed in claim 7 wherein the roller chain system comprises:

an upper mounting shaft mounted to the beam;

a first roller sprocket mounted to the upper mounting shaft;

a lower mounting shaft mounted to the beam;

a second roller sprocket mounted to the lower mounting shaft; and a roller chain engaged with the first and second roller sprockets.

9. An assembly as claimed in claim 3 wherein the gripper chain drive system comprises:

a pair of drive sprockets mounted to the common drive shaft;

a pair of idle sprockets mounted to the common idle shaft; and first and second gripper chains, having coil tubing string gripping blocks attached thereto, and engaged with the respective drive and idle sprockets, for gripping the respective first and second coil tubing strings to thereby move the first and second coil tubing strings through the frame structure as the pair of drive sprockets are rotated.

10. An assembly as claimed in claim 9 further comprising:

first and second pressure beams for supporting the respective first and second gripper chains, the first and second pressure beams being operatively mounted to the frame structure and respectively movable with respect to the frame structure;

first and second roller chain systems operatively mounted to the respective first and second pressure beams for reducing friction between the respective beams and the gripper chains when the pressure beams support the respective gripper chains; and means for moving the respective pressure beams towards or away from the respective coil tubing strings so that the gripper chains may be operated to independently engage the first and second coil tubing.

11. An assembly as claimed in claim 1 wherein the gripper chain drive system comprises:

first and a second drive shafts rotatably mounted to the frame structure;

first and a second drive sprockets mounted to the respective first and second drive shafts;

first and a second idle shafts rotatably mounted to the frame structure;

first and a second idle sprockets mounted to the respective first and second idle shafts; and first and a second gripper chains engaged with the respective first drive sprocket and first idle sprocket and second drive sprocket and second idle sprocket for respectively gripping the first and second coil tubing strings so that the first and second coil tubing strings may be injected into or withdrawn from the subterranean well synchronously or asynchronously.

12. An assembly as claimed in claim 11 wherein the first and second drive shafts are axially aligned with each other.

13. An assembly as claimed in claim 12 wherein the aligned first and second drive shafts are interconnected and independently rotatable.

14. An assembly as claimed in claim 13 wherein the first and second idle shafts are axially aligned and rotatably interconnected.

15. A coil tubing injector assembly comprising:

a frame structure;

a pair of gripper chain drive systems mounted to the frame structure, the gripper chain drive systems being disposed in a common plane, spaced apart from each other, and adapted to inject both a first and a second coil tubing string into, and withdraw both the first and second coil tubing strings from, a subterranean well;

each of the gripper chain drive systems including a first and a second gripper chain drive sub-system supported by the frame structure in a parallel relationship for gripping a one of the first and second coil tubing strings;

each of the gripper chain sub-systems including a drive shaft, an idle shaft, and a gripper chain having coil tubing string gripping blocks for engaging one of the coil tubing strings, the gripper chain being engaged with a drive sprocket and an idle sprocket mounted to the respective drive and idle shafts; and each of the gripper chain sub-systems being associated with a pressure beam mounted to the frame structure for supporting the gripper chain when the gripper chain engages the coil tubing string.

16. An assembly as claimed in claim 15 wherein each pressure beam is associated with a roller chain system for reducing friction between the pressure beam and the gripper chain, the respective pressure beams of each gripper chain sub-system being movable with respect to the frame structure to move the gripper chains of the respective gripper chain sub-systems toward or away from each other.

17. An assembly as claimed in claim 15 wherein the drive shafts of the sub-systems of each gripper chain drive system are integral and the drive sprockets mounted on the integral drive shafts have the same diameter, so that the first and second coil tubing strings are injected and withdrawn synchronously.

18. An assembly as claimed in claim 17 wherein the idle shafts of the sub-systems of each gripper chain drive system are integral and the idle sprockets mounted on the integral idle shaft have the same diameter.

19. An assembly as claimed in claim 15 wherein the pressure beam associated with each of the sub-systems is connected to an actuator mounted to the frame structure for moving the beam.

20. A coil tubing injector assembly comprising:

a frame structure;

a pair of substantially identical gripper chain drive systems mounted to the frame structure, disposed in a common plane and spaced apart from each other, and adapted to inject both a first and a second coil tubing string into, and withdraw both the first and second coil tubing strings from, a subterranean well;

each of the gripper chain drive systems including a drive shaft and an idle shaft respectively rotatably mounted to the frame structure, a gripper chain including coil tubing string gripping blocks adapted to grip both of the first and second coil tubing strings, the gripper chain being engaged with a drive sprocket and an idle sprocket mounted to the respective drive and idle shafts, each coil tubing string gripping block including a first side for engaging the first coil tubing string and a second side for engaging the second coil tubing string; and each of the gripper chain drive systems being associated with a pressure beam mounted to the frame structure for supporting the respective gripper chains.

21. An assembly as claimed in claim 20 wherein the pressure beam further includes a roller chain system for reducing friction between the pressure beam and the gripper chain.

22. A method of running coil tubing strings into a subterranean well to permit a downhole operation to be performed comprising:

injecting first and second coil tubing strings in parallel through a wellhead into the well using a coil tubing string injection apparatus adapted to inject the first and second coil tubing strings into the well simultaneously.

23. A method as claimed in claim 22 wherein the first coil tubing string is used for delivery of pressurized well stimulation fluid and the second coil tubing string is used for well bore cleanout in an event of screenout.

24. A method as claimed in claim 23 wherein the first coil tubing string is used for delivery of a pressurized well stimulation fluid above a packer or a plug in the well, and the second coil tubing string is used for delivery of a pressurized well stimulation fluid below the packer or the plug.

25. A method as claimed in claim 22 wherein the first coil tubing string is used for delivery of a pressurized stimulation fluid and the second coil tubing string is used to spot fluid associated with a well stimulation process.

26. A method as claimed in claim 22 wherein the first and the second coil tubing strings are injected synchronously.

27. A method as claimed in claim 26 wherein the first and the second coil tubing strings are connected at one end to a single well tool for performing a multiple-function downhole operation.

28. A method as claimed in claim 27 wherein the first coil tubing string is used for delivery of a pressurized well stimulation fluid and the second coil tubing string houses wiring for controlling a perforating gun.

29. A method as claimed in claim 26 wherein the first coil tubing string is used for delivery of a pressurized well stimulation fluid and the second coil tubing string is used for monitoring at least one of downhole well stimulation fluid injection pressure and temperature.

30. A method as claimed in claim 22 wherein the first and second coil tubing strings are injected asynchronously.

31. A method as claimed in claim 30 wherein the first coil tubing string is used for delivery of a pressurized well stimulation fluid into a first production zone and the second coil tubing string is used for delivery of a pressurized well stimulation fluid into a second production zone.

32. A method as claimed 31 wherein the first coil tubing string is used for delivery of a pressurized well fracturing fluid, and the second coil tubing is used for well cleanout in the event of screenout.

* * * * *